United States Patent [19]

Sadler et al.

[11] Patent Number: 4,541,323

[45] Date of Patent: Sep. 17, 1985

[54] WARSHIP WITH UNITS CONNECTED VIA ELECTRONIC CONTROL APPARATUSES

[75] Inventors: Karl O. Sadler; Jonny Worzeck, both of Hamburg, Fed. Rep. of Germany

[73] Assignee: Blohm + Voss AG, Hamburg, Fed. Rep. of Germany

[21] Appl. No.: 450,167

[22] Filed: Dec. 16, 1982

[30] Foreign Application Priority Data

Dec. 22, 1981 [DE] Fed. Rep. of Germany ..... 3150895

[51] Int. Cl.[4] ..... B63G 13/00; F41G 3/00

[52] U.S. Cl. ..... 89/41.14; 235/409; 235/411; 364/423

[58] Field of Search ..... 89/41 D, 41 R, 41 E; 235/409, 411, 412, 413; 364/423

[56] References Cited

U.S. PATENT DOCUMENTS

| | | | |
|---|---|---|---|
| 3,048,007 | 8/1962 | Campbell | 89/41 D |
| 3,288,030 | 11/1966 | Lind | 89/41 D |
| 3,737,630 | 6/1973 | Cox et al. | 89/41 D |
| 3,803,387 | 4/1974 | Lackowski | 89/41 D |
| 4,004,729 | 1/1977 | Rawicz et al. | 235/407 |
| 4,356,758 | 11/1982 | Teiling | 81/41 E |

FOREIGN PATENT DOCUMENTS

| | | | |
|---|---|---|---|
| 2247887 | 4/1974 | Fed. Rep. of Germany | 89/41 D |

*Primary Examiner*—Stephen C. Bentley

*Attorney, Agent, or Firm*—Townsend and Townsend

[57] ABSTRACT

Electronic control apparatuses (11, 12, 13) are provided for a warship having controlling and controlled units with a bedding (foundation) plane, with the control apparatuses forming control signals for the associated controlled units from the crude information coming from the associated controlling units. The electronic control apparatuses (11, 12, 13) have correction stages for each associated controlled unit for modifying the formed control signals in dependence on the bedding error of the associated controlled unit and/or of the controlling unit (19, 20, 21) which supplies the control apparatus (11, 12, 13). Furthermore, memories are provided for storing the bedding error values in dependence on the horizontal angular position of the controlled unit and/or of the controlling unit (FIG. 1).

2 Claims, 1 Drawing Figure

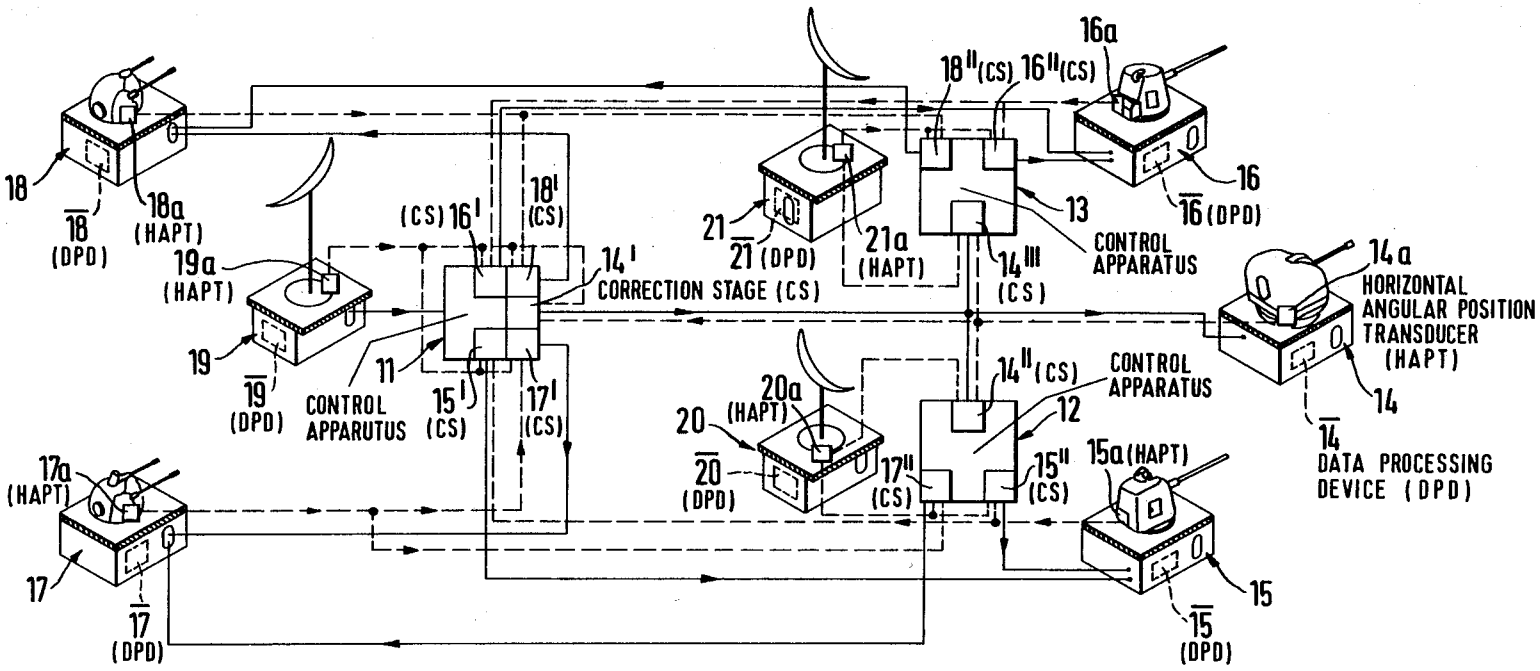
14a
HORIZONTAL ANGULAR POSITION TRANSDUCER (HAPT)
14
14 DATA PROCESSING DEVICE (DPD)
16
16 (DPD)
16a
16'' (CS)
18'' (CS)
CONTROL APPARATUS
13
14''' (CS)
CONTROL APPARATUS
12
14'' (CS)
15''
(CS)
15a (HAPT)
15
15 (DPD)
21a (HAPT)
21 (DPD)
21
17''
(CS)
20a (HAPT)
20
20 (DPD)
CORRECTION STAGE (CS)
14'
18'
(CS)
17'
(CS)
16'
(CS)
15'
(CS)
11
CONTROL APPARUTUS
19 (DPD)
19
19a (HAPT)
18a (HAPT)
18 (DPD)
18
17 (DPD)
17a (HAPT)
17

WARSHIP WITH UNITS CONNECTED VIA ELECTRONIC CONTROL APPARATUSES

The invention relates to a warship.

Amongst other things the invention relates to a warship which is provided with a standardised operating system in accordance with German Pat. No. 20 56 069 or German laying open print No. 31 05 349. It is important with such standardised operating systems, and also with other warships, that the controlling units (sensors) such as fire control units or radar units, and the controlled units (effectors) such as cannon units or rocket weapon units are aligned as accurately as possible in the ships coordinate system because accurate weapon control (guidance) is only possible with accurate relative alignment. Bedding (foundation) errors present with all such units manifest themselves in a cartesian coordinate system as a cosine function related to the size and position of the bedding error. In a polar coordinate system the error representation takes the form of a circle or double-circle, the diameter of which corresponds to the maximum bedding error. The angle between the diameter starting from the coordinate center point and the coordinate zero axis gives the spatial position of the maximum bedding error.

In order to remove the bedding error it is necessary to first measure the deviations of the bedding (foundation) plane from the main datum plane of the ship. This is then followed by an analysis of the determined bedding errors. Finally the bedding plane must be appropriately corrected whereupon a correlated bedding plane inclination is determined and a dynamic calibration established.

In a standardised operating system in accordance with German Pat. No. 20 56 069 the correction of the bedding plane can take place by vertically adjustable positioning screws on which the standard platform with the fire control unit, or weapon unit initially rests. However, despite accurate adjustment a certain rest error always remains which can become even larger due to distortion during later use of the ship.

Conventional methods for measuring and analysing bedding plane inclination values consists in measuring either only two values in the straight ahead and in the transverse direction of the ship and specifying the direction of the maximum inclination error (high point) from these values, or in taking a finite number of measurements (for example from 15 to 150) around the bedding plane to specify the high point by means of graphic interpolation. The first named method is able to provide information on the size and position of the maximum inclination provided the requirement set on accuracy are not too large. Graphic interpolation using a pair of compasses and a ruler consists in finding the positive and negative high points with an accuracy which is restricted by the resolution and subjective judgement of the human eye.

The two above named methods do not however make it possible to compensate for systematic errors such as inaccuracies in the reading of measurements, reference errors and trivial material and surface errors of the system foundations.

The object of the present invention is thus to provide a warship of the initially named kind in which bedding errors of the various units forming a functional chain have practically no influence on the quality of the weapon control.

In order to satisfy this object the invention provides that the electronic control apparatuses have correction stages for each associated controlled unit for modifying the control signals that are formed in dependence on bedding errors of the relevant controlled unit and/or the controlling unit feeding the control apparatus, the correction stages including memories for the bedding error values as a function of the horizontal angular position of the controlled unit and/or of the controlling unit and also receiving, or having inputs for input signals representative of the actual horizontal angular position of the controlled units and/or of the controlling units.

The thought underlying the invention is thus to be seen in the fact that one makes only a coarse alignment relative to the main datum plane of the ship of the bedding planes of the units which form a functional chain with one another, such as a fire control unit and the associated weapon unit, for example in accordance with the standardised operating system, and in other respects effects a pure electronic correction during use of the ship and its units. For this purpose it is only necessary that the bedding errors be found as accurately as possible as a function of the horizontal angular position of the individual unit, and that the vertical and horizontal correction values required for the individual horizontal angular positions then be determined, preferably by means of a suitable computer program. These correction values are then retained in the memory of the associated correction stage and are available at any time for modification of the control signals in dependence on the horizontal angular position of the units which form a functional chain with one another. As a controlling and at least one controlled unit are regularly connected together to form a functional chain the correction stages must take account of the bedding errors of both units.

Thus, in accordance with the invention corrected horizontal and vertical angle signals are passed from the correction stages to the attached controlling units. Horizontal angular position transducers should be provided at each controlling and/or controlled unit and connected with the associated correction stages. An individual control apparatus is expediently associated with each control unit.

To the extent that one is dealing with a warship in which the weapon units and fire control units are arranged on standard platforms in standard foundations the control apparatuses are expediently arranged at the standard platforms of the controlling units. Squarish containers in which the control apparatuses can also be housed are normally located beneath the platforms.

In a warship in accordance with the standardised operating unit system a data processing device which receives and transmits only digitised signals can however also be arranged, in accordance with the invention, in each unit. In this case the units should be connected by standard information transmission lines and a correction stage for the bedding errors of the associated unit should be present in each data processing device, with the actual horizontal angular position signals being brought into digitised form by the data processing devices and being transmitted in digitised form via the standard information transmission lines. This embodiment has the advantage that only standardised cabling or wiring is necessary between the individual units, independently of the special nature of the controlling or controlled unit, in as much as the data to be transmitted is brought in the individual data processing units into a digital form which can be transmitted via this standard line system. Thus special lines which in each case are only suited for quite specific fire control and weapon units do not need to be laid between the units. By using data processing devices and standard information transmission lines the same line system can continue to be used even on exchanging weapon unit containers or fire control unit containers. The cost and complexity for the wiring is thus considerably reduced.

BRIEF DESCRIPTION OF THE DRAWING

The invention will now be described by way of example in the following with reference to the drawing the single figure of which shows schematically, in the form of a block circuit diagram, five cannon units and three associated fire control units, which should be imagined as being arranged on a ship, and the control lines which connect them.

In the drawing, in the front part of the ship, there is arranged, on standard platforms, at the center a large caliber cannon unit 14 and, on both sides and somewhat rearwardly displaced, two small caliber cannons 15, 16. The standard platforms which close the tops of containers lie on non-illustrated standard foundations of the ships hull as described in detail in German Pat. No. 20 56 069. Twin gun units 17, 18 with containers located therebelow are arranged in the aft region of the ship, likewise on standard platforms.

In the fore region of the ship two fire control units 20, 21 are arranged on both sides of the longitudinal axis of the ship likewise on standard platforms. In the aft region of the ship a further fire control unit 19, which is likewise arranged in a non-illustrated standard foundation via a standard platform, is located amidships.

The fire control units 19, 20, 21 deliver crude information (for example horizontal angle, vertical angle, range) via control lines illustrated in broken lines to control apparatuses 11, 12 and 13 respectively, to which the weapon units associated with the fire control units are attached via connection lines likewise illustrated by broken lines. As the fire control unit 19 is suitable for controlling all the cannons 14, 15, 16, 17 and 18, control lines lead from the control apparatus 11 to each of these weapon units.

The fire control units 20, 21 arranged in the foreship are however only connected with the weapon units 14, 15, 17 and 14, 16, 17 respectively via the control units 12, 13 because they are only required for the control of these units.

Horizontal angular position transducers **14*a*, 15*a*, 16*a*, 17*a*, 18*a* and 19*a*, which are only illustrated schematically, are respectively arranged at each weapon unit and each fire control unit and give an electrical signal representative of the horizontal angle of the related unit relative to the longitudinal axis of the ship. These signals are passed via lines illustrated as broken lines to the control apparatuses 11, 12, 13**.

Correction stages 14', 15', 16', 17', 18'; 14'', 15'', 17''; and 14''', 16'', 18'', from which the control lines for the weapon units 14, 15, 16, 17, 18; 14, 15, 17 and 14, 16, 18 branch off, are located in each control apparatus 11, 12, 13 respectively.

The actual horizontal angle signals of the controlling unit (for example 19) and of the controlled unit(for example 18) are passed to each correction stage.

In the correction stages 14', 15', 16', 17', 18'; 14'', 15'', 17'' and 14''', 16'', 18'' there are housed memories in which the bedding errors of the associated controlling and controlled units are stored. As the actual value for the horizontal angle is passed to these correction stages via the lines illustrated as broken lines, the possibility exists of taking account of the bedding errors for each horizontal angle by corresponding modification of the control signals.

It has proved to be particular advantageous that the bedding error values stored in the memories of the correction stages can be updated from time to time so that accurate control of the weapon units by the fire control units is always possible without having to undertake any form of mechanical work on the ship.

If, for example, the aft fire control unit 19 is coupled with the cannon units 14, 17, 18 these four units form, in accordance with the invention, a functional chain or group. The port fire control unit 21 can then be coupled with the cannon unit 16 and the starboard control unit 20 can be coupled with the weapon unit 15. These two unit pairs then each form a functional chain.

As the control unit 11 is supplied with the horizontal angle positions of the fire control unit 19 and also of the associated weapon units 14, 17, 18 the control signals for the weapon units can be automatically corrected in accordance with the stored bedding error values for each horizontal angular position. The same happens in the correction stages 15'' and 16'' respectively of the control apparatuses 12, 13. In the control apparatus 11 the correction stages 14', 17' and 18' effect the required modifications of the control signals.

In the illustrated embodiment it is however also possible that the control apparatus 11 is coupled with all five weapon units 14, 15, 16, 17, 18. The fire control unit 20, 21 would in this case be inactive. It is however also possible to couple the fire control unit 20 with the weapon units 14, 15, 17 or the fire control unit 21 with the weapon units 14, 16, 18. In each case ideal correction of the bedding errors is achieved in the control apparatuses 11, 12, 13 by taking account of these functional chains.

The individually calculated pieces of information for the individual weapons, such as aiming, ballistics, data specific to the munitions, range restrictions for the weapon etc. are preferably stored in the correction stages 14', 15', 16', 17', 18'; 14'', 15'', 17'' and 14''', 16'', 18'' respectively.

In the drawing data processing devices $\overline{14}$, $\overline{15}$, $\overline{16}$, $\overline{17}$, $\overline{18}$, $\overline{19}$, $\overline{20}$, $\overline{21}$ respectively are also illustrated in each unit by broken line frames. This is intended to give expression to the fact that the control apparatuses 11, 12, 13 can be replaced by individual data processing devices in the units, with each data processing device taking account of the specific errors of the associated unit. The horizontal angular position signals can be transmitted in digitised form between the units via a standard information transmission line system. In this manner special cabling for a specific system of units can be avoided and can be replaced by a standardised digital signal cabling suitable for different unit systems.

It is of particular advantage that the bedding error values fed into the control apparatus, or into the data processing devices, can be found and stored much more rapidly then was previously the case when removing these bedding errors mechanically.

We claim:

1. A warship having a longitudinal axis and a main datum plane comprising at least one weapon unit and at least one sensing unit for controlling the relative angular position of the weapon unit, each unit being mounted on the ship on a respective bedding plane and pivotally movable in a generally horizontal plane through a range of horizontal angles and in a generally vertical plane through a range of vertical angles, the sensing unit providing as an output crude control information relating to the horizontal and vertical angles for a desired position of the weapon unit; a horizontal angular position transducer for each of the sensing and weapon units generating electrical signals during pivotal movement of the units in the horizontal plane representative of the instantaneous horizontal angular position of the associated unit; electronic control means receiving as a first input the crude information for generating therefrom a control signal determining the horizontal and vertical angles corresponding to the desired position of the weapon unit and corrected for misalignments of the bedding planes of the sensing and weapon units relative to the datum plane, the electronic control means included preloaded memories storing bedding error values reflecting misalignments of the respective bedding planes of the sensing unit and the weapon unit from the datum plane for all possible angular positions of the sensing unit and the weapon unit; means providing as a second input to the electronic control means said electrical signals generated by the transducers for selecting the appropriate address in the preloaded memory storing the bedding error values for the respective angular positions of the units; the electronic control means applying the appropriate bedding error values selected from the memories to the crude information to thereby generate the control signal as the output of the electronic control means; and means for applying the control signal to the weapon unit for moving the weapon unit into the desired position, corrected for misalignments between the respective bedding planes and the datum plane.

2. A warship according to claim 1 wherein the electronic control means generates a control signal comprising a first control signal determining the vertical angle of the weapon unit and a second control signal determining the horizontal angle of the weapon unit, each in the desired position and corrected for misalignments between the respective bedding planes and the datum plane.

* * * * *